US009915403B2

(12) United States Patent
Yagi et al.

(10) Patent No.: US 9,915,403 B2
(45) Date of Patent: Mar. 13, 2018

(54) VEHICLE LAMP

(71) Applicant: KOITO MANUFACTURING CO., LTD., Tokyo (JP)

(72) Inventors: Takayuki Yagi, Shizuoka (JP); Takeshi Masuda, Shizuoka (JP); Yuichi Shibata, Shizuoka (JP); Satoshi Yamamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/113,527

(22) PCT Filed: Jan. 14, 2015

(86) PCT No.: PCT/JP2015/050805
§ 371 (c)(1),
(2) Date: Jul. 22, 2016

(87) PCT Pub. No.: WO2015/111483
PCT Pub. Date: Jul. 30, 2015

(65) Prior Publication Data

US 2017/0009948 A1 Jan. 12, 2017

(30) Foreign Application Priority Data

Jan. 24, 2014 (JP) ..... 2014-011344
Jan. 31, 2014 (JP) ..... 2014-017398

(51) Int. Cl.
*F21S 8/10* (2006.01)
*F21Y 115/10* (2016.01)

(52) U.S. Cl.
CPC ..... *F21S 48/1225* (2013.01); *F21S 48/115* (2013.01); *F21S 48/1154* (2013.01); *F21S 48/1159* (2013.01); *F21S 48/125* (2013.01); *F21S 48/1305* (2013.01); *F21S 48/1394* (2013.01); *F21S 48/1721* (2013.01);
(Continued)

(58) Field of Classification Search
None
See application file for complete search history.

(56) References Cited

U.S. PATENT DOCUMENTS 5,285,362 A 2/1994 Sakata
2005/0117361 A1 6/2005 Takeda et al.
2008/0036351 A1 2/2008 Muller et al.
(Continued)

FOREIGN PATENT DOCUMENTS

CN 1664440 A 9/2005
CN 101057166 A 10/2007
(Continued)

OTHER PUBLICATIONS

Machine Translation of Kazunari JP 2001-160377A.*
(Continued)

*Primary Examiner* — Kristy A Haupt
(74) *Attorney, Agent, or Firm* — Sughrue Mion, PLLC

(57) ABSTRACT

Provided is a vehicle lamp with high visibility of road signs. This vehicle lamp (1) is provided with a light source (10) which emits light of a prescribed spectrum and an optical member (30) which is provided on an optical path of the light and increases the number of peaks in the spectrum of the light.

6 Claims, 14 Drawing Sheets

(52) U.S. Cl.
CPC ..... *F21S 48/325* (2013.01); *F21S 48/328* (2013.01); *F21Y 2115/10* (2016.08)

(56) References Cited

U.S. PATENT DOCUMENTS

| | | | |
|---|---|---|---|
| 2010/0110715 | A1 | 5/2010 | Nakada |
| 2011/0248624 | A1 | 10/2011 | Kishimoto et al. |

FOREIGN PATENT DOCUMENTS

| | | | |
|---|---|---|---|
| CN | 102252247 | A | 11/2011 |
| JP | H 5-67453 | A | 3/1993 |
| JP | H 11-25709 | A | 1/1999 |
| JP | 2001160377 | A | 6/2001 |
| JP | 2008268757 | A | 11/2008 |
| JP | 2010108727 | A | 5/2010 |
| JP | 2011100555 | A | 5/2011 |

OTHER PUBLICATIONS

Machine Translation of Manabu JP 11025709A.*
Search Report (PCT/ISA/210) dated Feb. 17, 2015, issued by the International Searching Authority in counterpart International Application No. PCT/JP2015/050805.
Written Opinion (PCT/ISA/237) dated Feb. 17, 2015, issued by the International Searching Authority in counterpart International Application No. PCT/JP2015/050805.
Communication dated Dec. 4, 2017, from the State Intellectual Property Office of People's Republic of China in counterpart Application No. 201580005533.1.

* cited by examiner

VEHICLE LAMP

TECHNICAL FIELD

The present invention relates to a vehicle lamp.

BACKGROUND ART

A vehicle lamp capable of improving visibility of road signs is known in Patent Document 1, etc.

CITATION LIST

Patent Document

Patent Document 1: Japanese Patent Laid-Open Publication No. 2010-108727

DISCLOSURE OF INVENTION

Problems to be Solved by Invention

The present inventors have found that there is room for further improving visibility of road signs in the vehicle lamp described above.

The present invention aims to provide a vehicle lamp having high visibility of road signs.

Means for Solving the Problems

A vehicle lamp of the present invention includes a light source configured to emit light of a prescribed spectrum; and an optical member provided on an optical path of the light and configured to increase the number of peaks in the spectrum of the light.

Generally, in road signs, specific color shade portions such as blue, green and red are combined. According to the vehicle lamp of the present invention, out of light emitted from the light source, light with certain wavelength is attenuated by the optical member, and hence, the light where the number of peaks is increased is emitted from the vehicle lamp. Thus, luminous intensity of light with a peak wavelength is greater than that of light with other wavelength. Therefore, by selecting the optical member such that a peak is formed at a wavelength corresponding to a specific color shade of road signs, a specific color shade portion of the road signs is evidently illuminated than an object of other colors. In this way, it is possible to provide a vehicle lamp in which visibility of road signs is improved.

In the vehicle lamp of the present invention, light having at least two or more peaks may be emitted to the front of the vehicle lamp by the optical member.

Further, light having at least three or more peaks may be emitted to the front of the vehicle lamp by the optical member.

According to the vehicle lamp of the present invention, it is possible to favorably handle road signs in which two or three or more colors are combined.

In the vehicle lamp of the present invention, a light-transmitting member configured to transmit the light may be provided on the optical path of the light, and the optical member may be provided in the light-transmitting member.

According to the vehicle lamp of the present invention, a separate structure for supporting the optical member is not required and it is not necessary to change the design of an existing vehicle lamp.

In the vehicle lamp of the present invention, a light-reflecting member configured to reflect the light may be provided on the optical path of the light, and the optical member may be provided in the light-reflecting member.

According to the vehicle lamp of the present invention, a separate structure for supporting the optical member is not required and it is not necessary to change the design of an existing vehicle lamp.

Further, a vehicle lamp of the present invention includes a light source configured to emit light of a spectrum having at least two peaks; and an optical member provided on an optical path of the light and configured to attenuate light having a wavelength between the peaks of the light.

In the vehicle lamp of the present invention, a housing having an opening on the front side may be provided, and the optical member may be an outer cover which closes the opening to form a lamp chamber together with the housing.

In the vehicle lamp of the present invention, a housing having an opening and an outer cover for closing the opening to form a lamp chamber together with the housing may be provided, and the optical member may be an inner lens provided on the optical path in the lamp chamber.

In the vehicle lamp of the present invention, the optical member may be a reflector which is provided on the optical path and reflects light emitted from the light source.

In the vehicle lamp of the present invention, a transmission spectrum of the optical member may have a peak at a wavelength corresponding to the peak of light emitted from the light source.

In the vehicle lamp of the present invention, the light source may emit light having at least two peaks which become a white light when combined with each other.

Effects of Invention

According to the present invention, a vehicle lamp having high visibility of road signs is provided.

EMBODIMENT FOR CARRYING OUT INVENTION

<First Embodiment>

Hereinafter, a vehicle lamp according to a first embodiment of the present invention will be described in detail with reference to the drawings. The vehicle lamp of the present embodiment is a lamp which is provided on the front portion of a vehicle, and especially, can be suitably irradiated to road signs.

Figure 1:
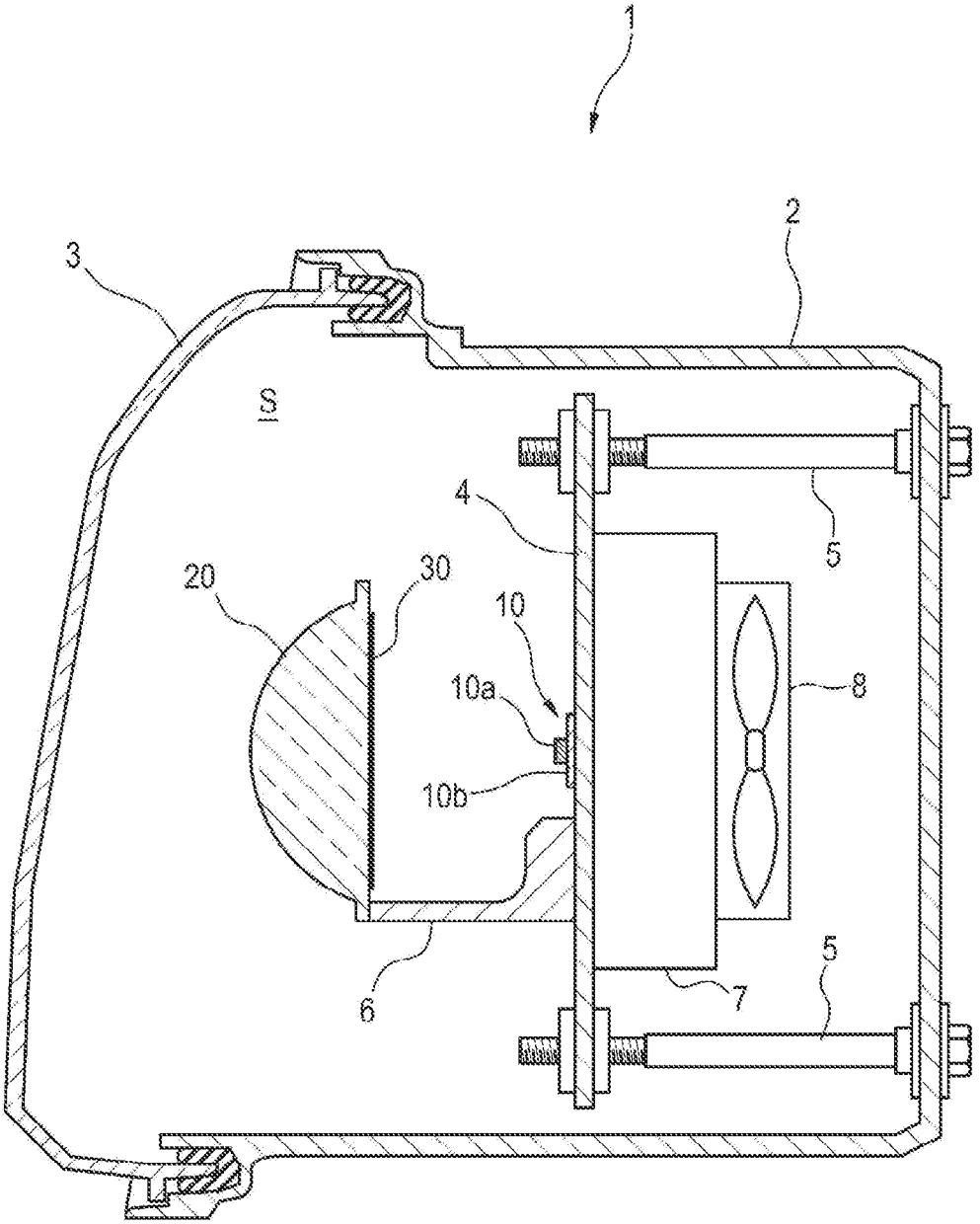
FIG. 1 is a side sectional view of a vehicle lamp according to a first embodiment of the present invention.

FIG. 1 is a side sectional view of a vehicle lamp 1 according to the present embodiment. As shown in FIG. 1, the vehicle lamp 1 includes a housing 2 having an opening on the front side and an outer cover 3 for closing the opening to form a lamp chamber together with the housing 2. In the interior of the lamp chamber S, the vehicle lamp 1 includes an LED light source 10 and a projection lens 20 (an example of the light-transmitting member) provided on an optical path of light emitted from the LED light source 10. The light emitted from the LED light source 10 is transmitted through the projection lens 20 and is emitted to the front of the lamp.

The LED light source 10 includes an LED (Light Emitting Diode) element 10*a* and a circuit board 10*b* on which the LED element 10*a* is mounted. The LED element 10*a* has a light emitting element to emit a blue light and a phosphor to convert the blue light into a yellow light. The LED element emits a white light by mixing the blue light and the yellow light. The LED light source 10 is supported on a front surface of a support substrate 4. The support substrate 4 is attached to the housing 2 through an aiming screw 5.

In the projection lens 20, a rear focal point is located at a position near the LED element 10*a*. The projection lens 20 is fixed to a lens holder 6 extending forward from the support substrate 4.

A heat sink 7 and a heat dissipation fan 8 are provided on a rear surface of the support substrate 4. The heat sink 7 and the heat dissipation fan 8 dissipate heat generated from the LED light source 10 provided on the front surface of the support substrate 4.

As shown in FIG. 1, a multi-layer film filter 30 (an example of the optical member) is formed on a rear surface of the projection lens 20. The multi-layer film filter 30 is formed on the rear surface of the projection lens 20 by deposition. The multi-layer film filter 30 has optical characteristics that light of a specific wavelength band in a visible light range is transmitted and light of other wavelength bands is not transmitted.

The multi-layer film filter 30 can be produced by laminating a semi-transparent metal film, a transparent dielectric film and a semi-transparent metal film by using, for example, a plasma ion process (an example of the deposition). The multi-layer film filter 30 can be produced by laminating, for example, $Ta_2O_3$, $Ti_2O_3$, $Si_2O_3$ or the like. For example, a multi-band pass filter (Model No. #87-245) made by Edmund Optics Inc., can be used as the multi-layer film filter 30.

Next, the optical characteristics of the vehicle lamp 1 are described with reference to FIGS. 2A to 2C.

Figure 2A:
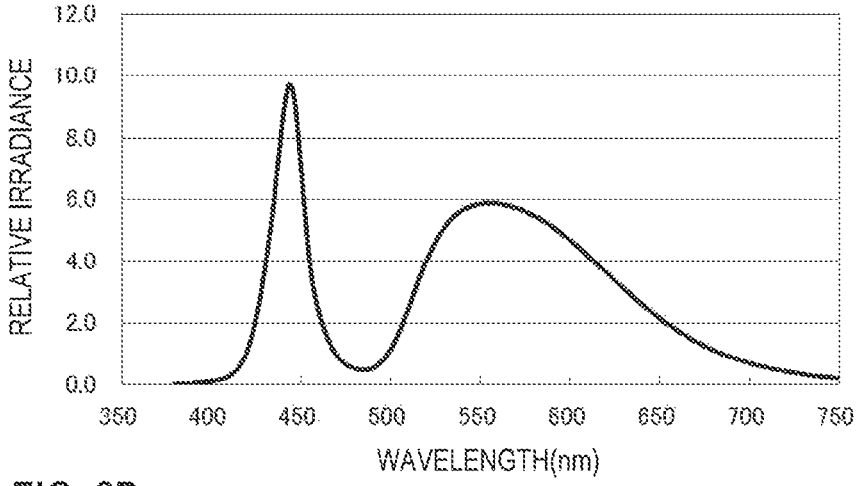
FIGS. 2A to 2C are views showing the optical characteristics of the vehicle lamp.

FIG. 2A is a view showing an emission spectrum of light emitted from the LED light source 10. FIG. 2B is a view showing a transmission spectrum of the multi-layer film filter 30. FIG. 2C is a view showing a spectrum of light transmitted through the multi-layer film filter 30.

As shown in FIG. 2A, the spectrum of light emitted from the LED light source 10 has two peaks in the visible light range. The spectrum of the light has peaks near 445 nm and near 560 nm in the visible light range.

Figure 2B:
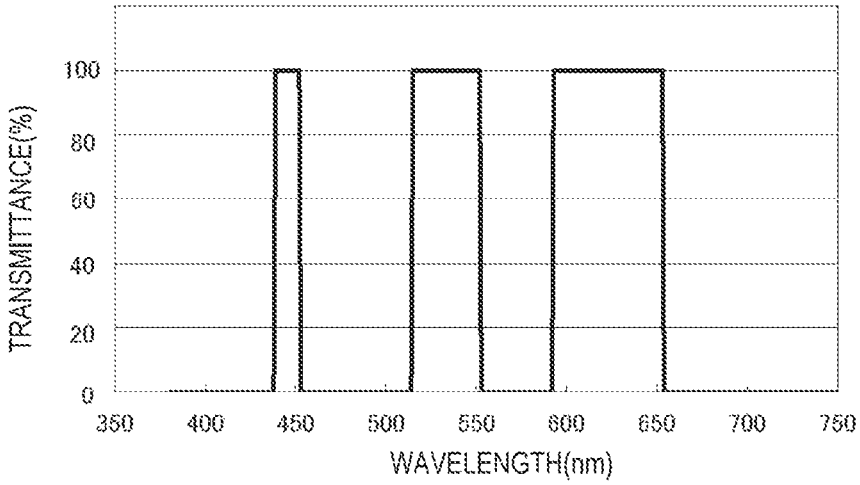

As shown in FIG. 2B, the multi-layer film filter 30 of the present embodiment has optical characteristics that transmittance of light with the wavelength of 440 nm to 450 nm, 520 nm to 550 nm, and 590 nm to 650 nm is 100% and transmittance of light with other wavelength band is 0%.

When the light emitted from the LED light source 10 passes through the multi-layer film filter 30, out of the light emitted from the LED light source 10, the light with the wavelength of 550 nm to 590 nm is not transmitted. Therefore, the peak formed over the wavelength of 520 nm to 650 nm is divided into two.

Figure 2C:
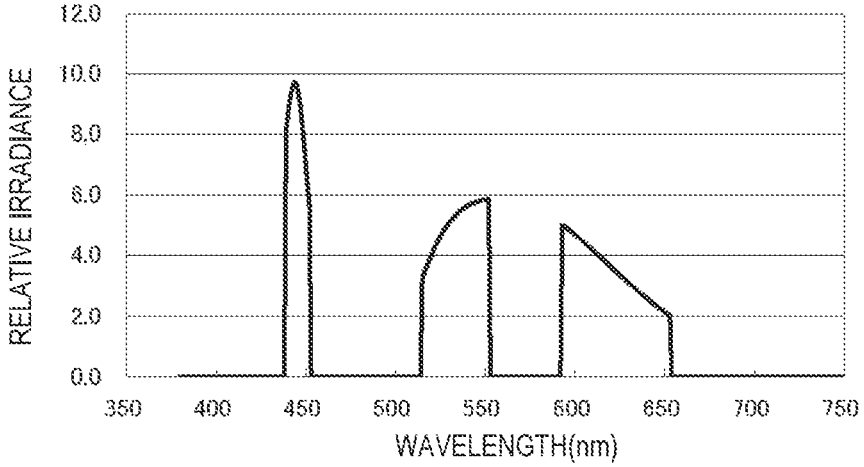

Therefore, as shown in FIG. 2C, the spectrum of light emitted from the LED light source 10 and passed through the multi-layer film filter 30 has three peaks. The spectrum of the light has a peak formed over the wavelength of 440 nm to 450 nm, a peak formed over the wavelength of 520 nm to 550 nm, and a peak formed over the wavelength of 590 nm to 650 nm.

Thus, according to the vehicle lamp 1 of the present embodiment, out of the light emitted from the LED light source 10, the light with a specific wavelength is transmitted by the multi-layer film filter 30 and the light with other wavelength is attenuated by the multi-layer film filter 30, thereby increasing the number of peaks. When the multi-layer film filter 30 is configured such that a peak is formed at a wavelength corresponding to a specific color shade of road signs, the road signs are evidently illuminated.

Specifically, in the vehicle lamp 1 of the present embodiment, the multi-layer film filter 30 has a transmission spectrum shown in FIG. 2B. Therefore, out of the light passed through the multi-layer film filter 30, the light with the wavelength of 440 nm to 450 nm illuminates a blue object, the light with the wavelength of 520 nm to 550 nm illuminates a green object, and the light with the wavelength of 590 nm to 650 nm illuminates a red object. The light with other wavelength bands is attenuated by the multi-layer film filter 30 and is irradiated, in weak luminous intensity, to the front of the lamp. Therefore, the reflective brightness of the blue object, the green object and the red object becomes higher than that of the objects in other colors. When the vehicle lamp 1 irradiates light on road signs configured by a combination of a blue portion, a green portion and a red portion, the blue portion, the green portion and the red portion of the road signs are more emphasized than the objects in other colors, thereby improving visibility of the road signs.

Further, since the vehicle lamp 1 of the present embodiment can emit light having three peaks to the front of the lamp, the light can be evidently irradiated to the road signs composed of three colors, thereby improving visibility of the road signs.

In the present embodiment, the projection lens 20 for transmitting the light from the LED light source 10 is provided on an optical path of the light and the multi-layer film filter 30 is provided in the projection lens 20. Therefore, it is not necessary to separately provide a structure for supporting the multi-layer film filter 30. As a result, the multi-layer film filter 30 can be provided in a vehicle lamp having an existing projection lens without changing the design of the vehicle lamp, and hence, versatility is high.

Meanwhile, the number of peaks or the width of peaks of light to be formed by the multi-layer film filter 30 is not limited to the above embodiment. For example, the number of peaks or the width of peaks can be properly selected in accordance with the color shades of target road signs. Now, first to third modified examples where at least one of the optical member and the light source is changed from the above embodiment are described.

<First Modified Example>

In a first modified example, the characteristics of the multi-layer film filter 30 are changed from the vehicle lamp 1 of the first embodiment described above.

Figure 3A:
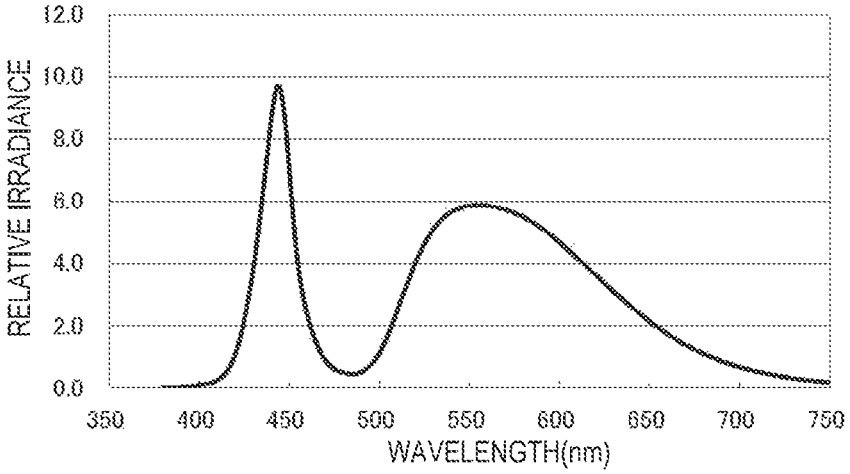
FIGS. 3A to 3C are views showing the optical characteristics of a vehicle lamp according to a first modified example of the present invention.
Figure 3B:
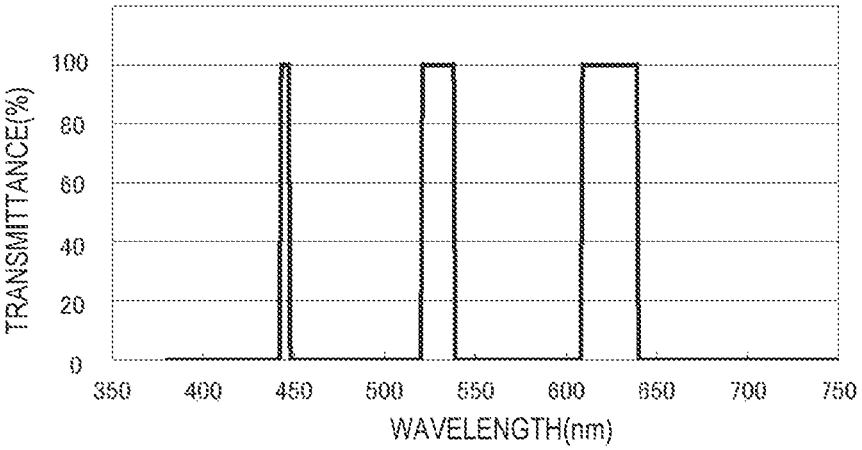
Figure 3C:
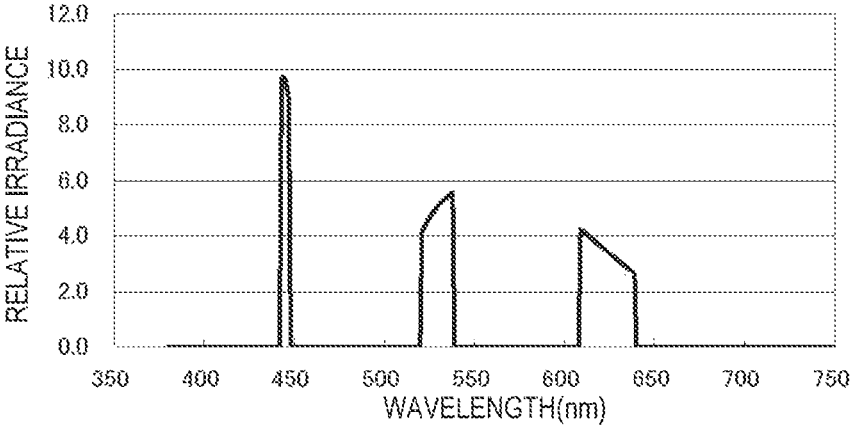

FIGS. 3A to 3C are views for explaining the optical characteristics of a vehicle lamp 1 according to the first modified example. FIG. 3A is a view showing an emission spectrum of light emitted from the LED light source 10. FIG. 3B is a view showing a transmission spectrum of the multi-layer film filter 30. FIG. 3C is a view showing a spectrum of light transmitted through the multi-layer film filter 30.

Since the LED light source 10 of the vehicle lamp 1 of the present modified example is the same as the LED light source 10 of the first embodiment, FIG. 3A showing the spectrum of the light emitted from the LED light source 10 is the same as FIG. 2A. The spectrum of the light has a peak near 445 nm and a peak near 560 nm.

As shown in FIG. 3B, the multi-layer film filter 30 of the present modified example has characteristics that a transmitting wavelength band is narrower than in the multi-layer film filter 30 used in the first embodiment. The multi-layer film filter 30 has optical characteristics that transmittance of light with the wavelength of 445 nm to 450 nm, 520 nm to 540 nm, and 610 nm to 640 nm is 100% and transmittance of light with other wavelength bands is 0%.

Therefore, as shown in FIG. 3C, the spectrum of light emitted from the LED light source 10 and passed through the multi-layer film filter 30 has three peaks. Half-width of these peaks is narrower than that of the peaks of the first embodiment shown in FIG. 2C. The spectrum of the light has a peak formed over the wavelength of 445 nm to 450 nm, a peak formed over the wavelength of 520 nm to 540 nm and a peak formed over the wavelength of 610 nm to 640 nm.

According to the vehicle lamp 1 of the present modified example, light can be evidently irradiated to road signs having a color shade corresponding to the wavelength of the peak formed by the multi-layer film filter 30. Therefore, visibility of the road signs can be improved.

Especially, according to the vehicle lamp 1 of the first modified example, light with a narrower wavelength band can be irradiated to the front of the lamp, as compared with the vehicle lamp of the first embodiment. Therefore, the road signs having a color corresponding to the light with this wavelength can be more emphasized.

<Second Modified Example>

Also in a second modified example, the characteristics of the multi-layer film filter 30 are changed from the vehicle lamp of the first embodiment described above.

Figure 4A:
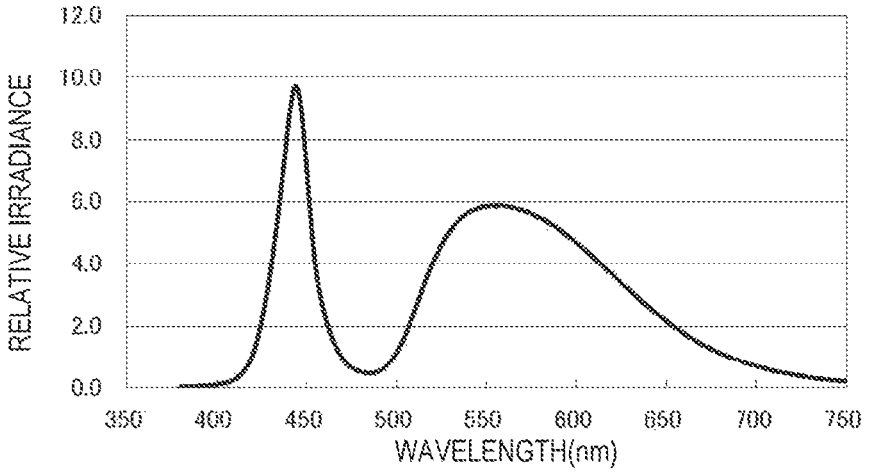
FIGS. 4A to 4C are views showing the optical characteristics of a vehicle lamp according to a second modified example of the present invention.
Figure 4B:
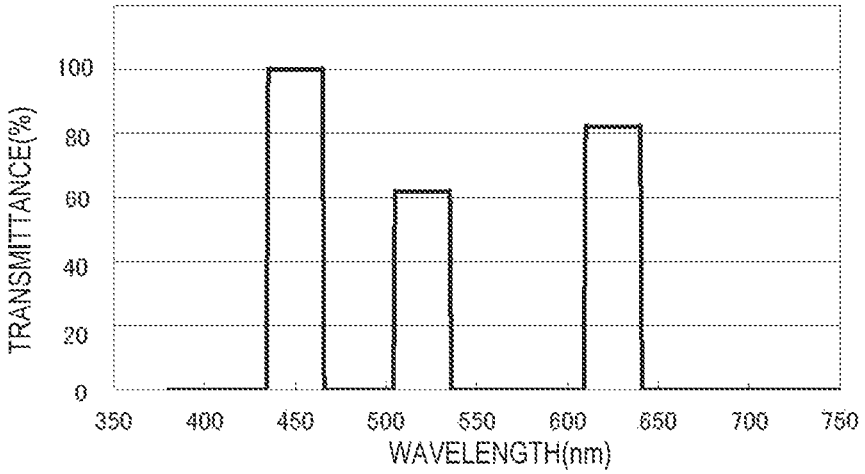
Figure 4C:
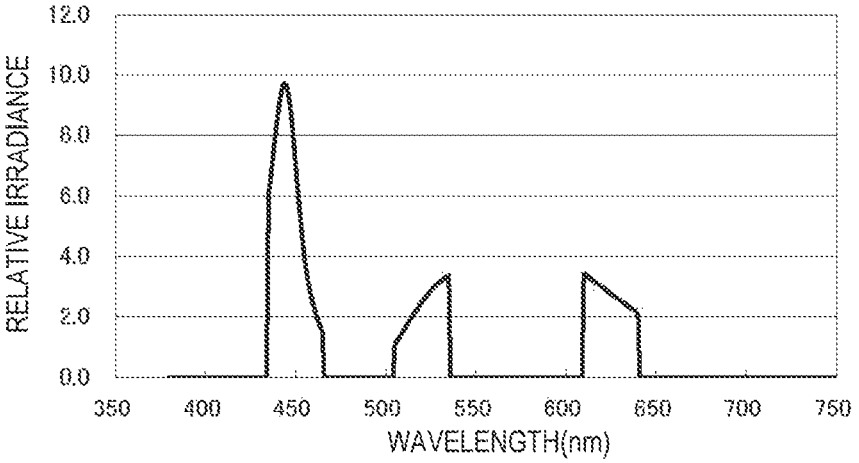

FIGS. 4A to 4C are views for explaining the optical characteristics of a vehicle lamp 1 according to the second modified example. FIG. 4A is a view showing an emission spectrum of light emitted from the LED light source 10. FIG. 4B is a view showing a transmission spectrum of the multi-layer film filter 30. FIG. 4C is a view showing a spectrum of light transmitted through the multi-layer film filter 30.

Since the LED light source 10 of the vehicle lamp 1 of the present modified example is the same as the LED light source 10 of the first embodiment, FIG. 4A showing the spectrum of the light emitted from the LED light source 10 is the same as FIG. 2A. The spectrum of the light has a peak near 445 nm and a peak near 560 nm.

As shown in FIG. 4B, the multi-layer film filter 30 of the present modified example has optical characteristics that transmittance of light with the wavelength of 445 nm to 450 nm is 100%, transmittance of light with the wavelength of 520 nm to 540 nm is 60%, transmittance of light with the wavelength of 610 nm to 640 nm is 80% and transmittance of light with other wavelength bands is 0%.

Therefore, as shown in FIG. 4C, the spectrum of light emitted from the LED light source 10 and passed through the multi-layer film filter 30 has three peaks. The spectrum of the light has a peak formed over the wavelength of 445 nm to 450 nm, a peak formed over the wavelength of 520 nm to 540 nm and a peak formed over the wavelength of 610 nm to 640 nm.

According to the vehicle lamp 1 of the present modified example, light can be evidently irradiated to the road signs having a color shade corresponding to the wavelength of the peak formed by the multi-layer film filter 30. Therefore, visibility of the road signs can be improved.

Especially, for the light emitted from the vehicle lamp 1 of the second modified example, luminous intensity of light with the wavelength of 445 nm to 450 nm is greater than in other peaks, as compared with the first embodiment and the first modified example described above. Therefore, reflective brightness of the blue portion corresponding to the light with the wavelength of 445 nm to 450 nm becomes greater than that of the light with other wavelength, so that the blue portion of road signs is evidently visible.

<Third Modified Example>

In a third modified example, the light source is changed from the LED light source 10 to a halogen light source 11, unlike the vehicle lamp 1 of the first embodiment. Further, a multi-layer film filter 30 having optical characteristics different from the multi-layer film filter 30 of the first embodiment is used.

Figure 5A:
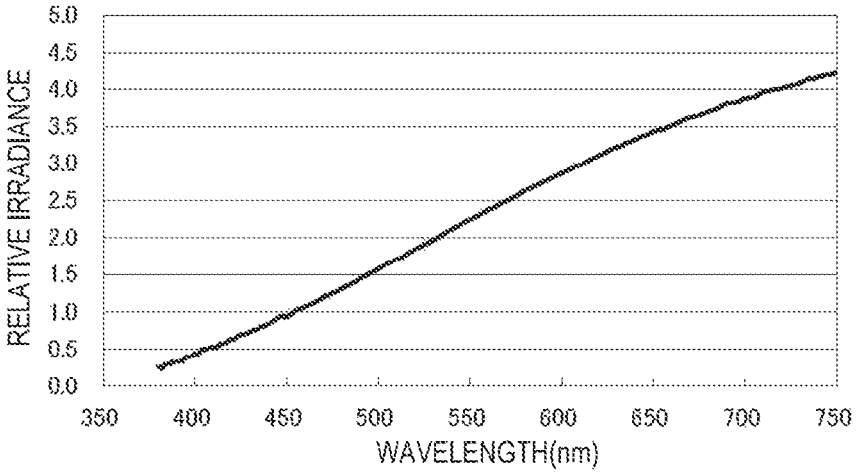
FIGS. 5A to 5C are views showing the optical characteristics of a vehicle lamp according to a third modified example of the present invention.
Figure 5B:
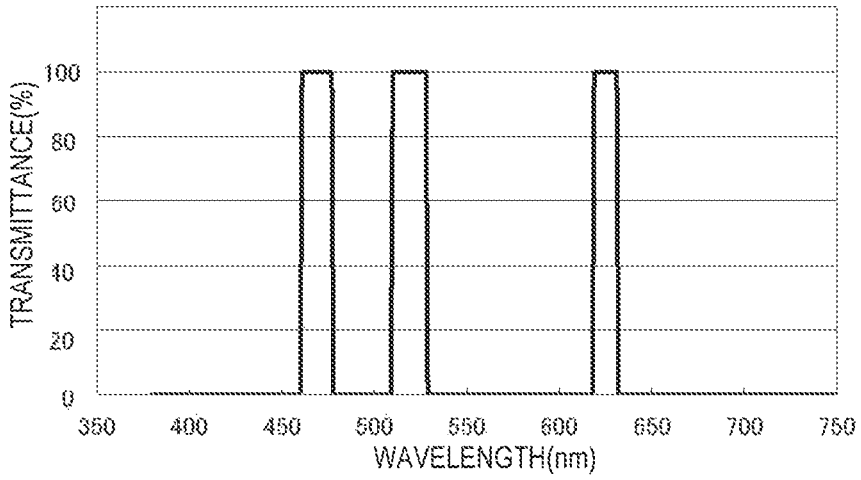
Figure 5C:
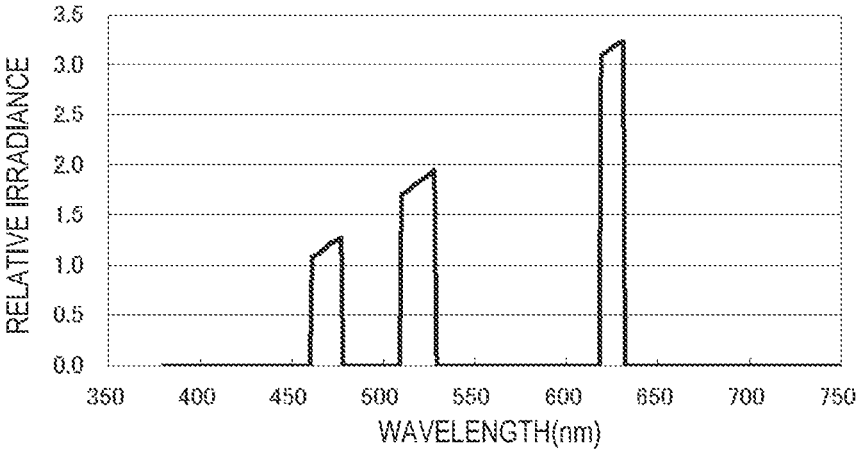

FIG. 5A is a view showing an emission spectrum of light emitted from the halogen light source 10 of the vehicle lamp 1 of the third modified example. FIG. 5B is a view showing a transmission spectrum of the multi-layer film filter 30. FIG. 5C is a view showing a spectrum of light transmitted through the multi-layer film filter 30.

As shown in FIG. 5A, the halogen light source 11 of the present modified example has a spectrum where relative irradiance is increased from a short wavelength toward a long wavelength in the wavelength band of visible light and a peak is not present.

As shown in FIG. 5B, the multi-layer film filter 30 of the present modified example has characteristics that transmittance of light with the wavelength of 460 nm to 480 nm, 510 nm to 530 nm, and 620 nm to 630 nm is 100% and transmittance of light with other wavelength bands is 0%.

Therefore, as shown in FIG. 5C, the spectrum of light emitted from the halogen light source 11 and passed through the multi-layer film filter 30 has three peaks. The spectrum of the light has a peak formed over the wavelength of 460 nm to 480 nm, a peak formed over the wavelength of 510 nm to 530 nm and a peak formed over the wavelength of 620 nm to 630 nm.

According to the vehicle lamp 1 of the present modified example, light can be evidently irradiated to the road signs having a color shade corresponding to the wavelength of the peak formed by the multi-layer film filter 30. Therefore, visibility of the road signs can be improved.

Especially, as is apparent from a comparison between FIG. 5A and FIG. 4A, light with various wavelengths is included in the halogen light source 11, as compared with the LED light source 10. Therefore, when, unlike the present embodiment, light emitted from the halogen light source 11 is irradiated as it is to the front of the lamp, road signs with a specific color shade are not evidently visible. Accordingly, visibility of road signs cannot be improved. However, when, as in the third modified example, light emitted from the halogen light source 11 is transmitted through the multi-layer film filter 30, only the light with a specific wavelength band can be irradiated to the front of the lamp, and hence, only the road signs with a specific color shade can be emphasized.

Figure 6:
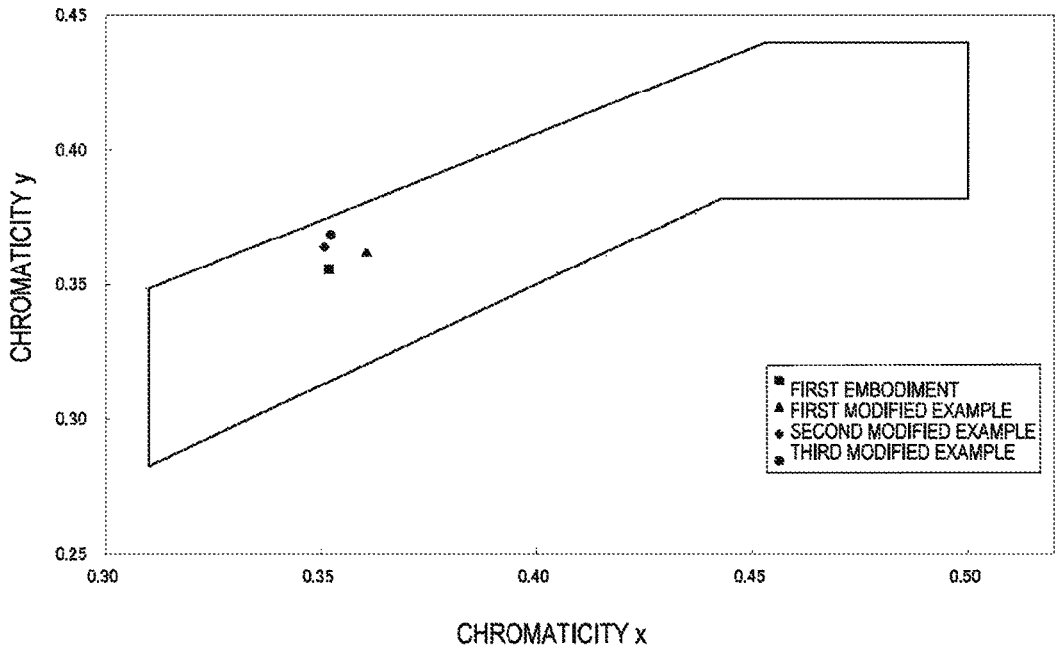
FIG. 6 is a view showing chromaticity of light that is irradiated by the vehicle lamp.

Meanwhile, the multi-layer film filter 30 is preferably designed such that the light illuminated from the vehicle lamp 1 is a white light. FIG. 6 shows the measurement results of chromaticity of light emitted from the vehicle lamp 1 according to the first embodiment and the first to third modified examples. As shown in FIG. 6, chromaticity of light emitted from the vehicle lamp 1 according to the first embodiment and the first to third modified examples is included in a chromaticity range A suitable for a vehicle headlamp, in which chromaticity x and y is specified in JIS D5500, and the vehicle lamp 1 emits a white light to the front of the lamp.

Therefore, the vehicle lamp 1 according to the first embodiment and the first to third modified examples can be applied to an existing vehicle headlamp. Further, even when a white portion is included in the road signs described above, it is possible to improve visibility of the road signs.

In the above-described embodiments, an example where light having three peaks is emitted to the front of the lamp by the multi-layer film filter 30 has been described. However, the present invention is not limited to this configuration. Preferably, light having at least two or more peaks is emitted to the front of the lamp by the multi-layer film filter 30. Light can be evidently irradiated to road signs in which two or more colors are combined, thereby improving visibility of the road signs.

In the first embodiment described above, an example where the multi-layer film filter 30 is deposited on the rear surface of the projection lens 20 has been described. However, the present invention is not limited to this configuration. For example, the multi-layer film filter 30 may be formed on at least one of the rear surface and front surface of the projection lens 20, specifically, on the portion through which light to illuminate a region having road signs located thereon passes.

Further, the position where the multi-layer film filter 30 is provided is not limited to the projection lens 20, so long as the multi-layer film filter 30 is provided on the optical path of light emitted from the light source. The multi-layer film filter 30 can be provided in a light-transmitting member for transmitting light emitted from the light source. For example, the multi-layer film filter 30 may be provided on various inner lenses provided in the lamp chamber S, such as a light pipe, alternatively, on the outer cover 3. Further, the multi-layer film filter 30 may be formed on the light emitting surface of the LED light source 10 or the halogen light source 11.

<Second Embodiment>

The multi-layer film filter 30 may be provided on a light-reflecting member, which is provided on the optical path of light emitted from the light source and reflects the light. Subsequently, a second embodiment of the present invention where an optical film 31 as an example of the optical member is provided on a reflector 40 as an example of the light-reflecting member is described.

Figure 7:
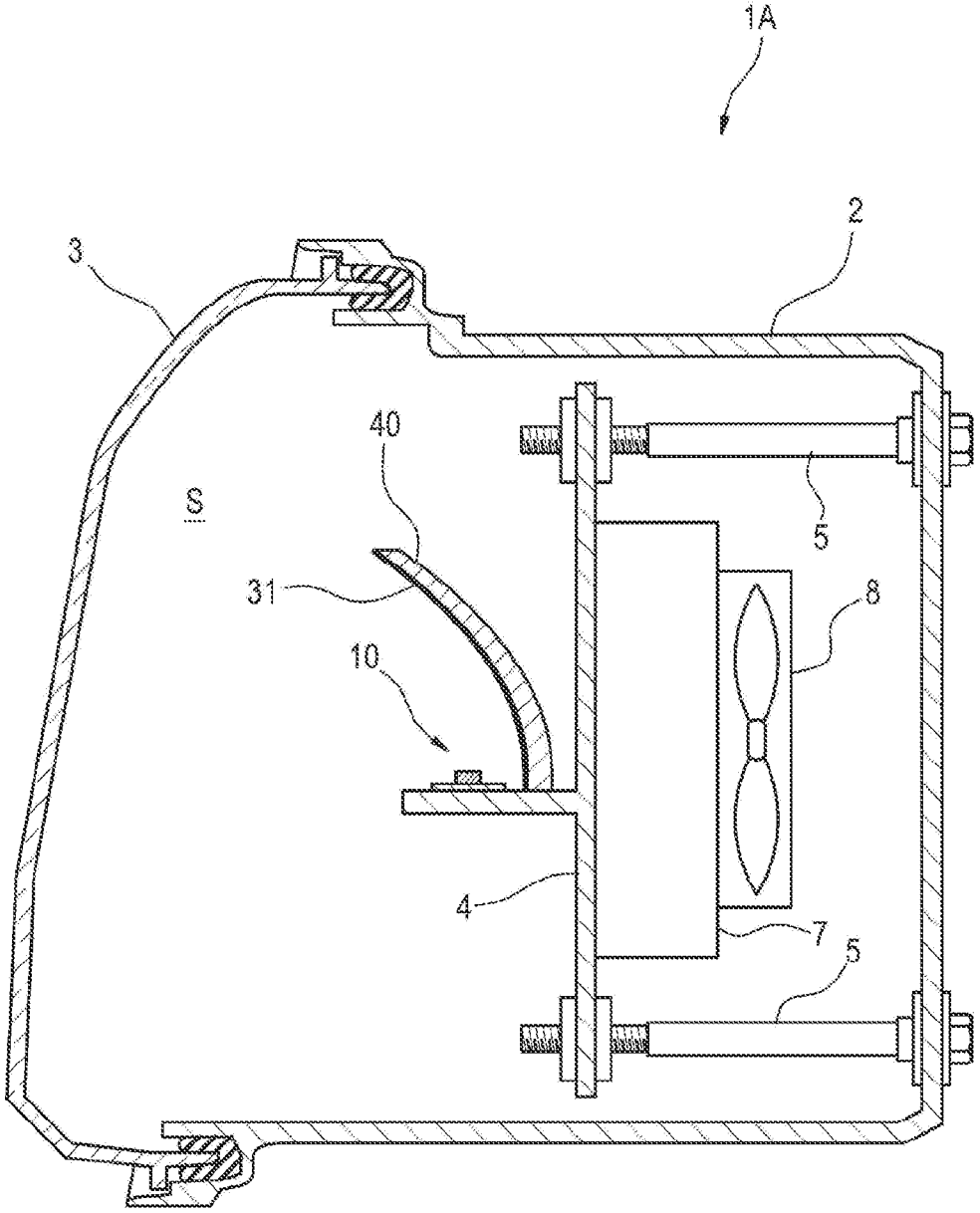
FIG. 7 is a side sectional view of a vehicle lamp according to a second embodiment of the present invention.

FIG. 7 is a side sectional view of a vehicle lamp 1A according to a second embodiment of the present invention. The same members as those of the first embodiment described above are denoted by the same reference numerals and a detailed description thereof is omitted.

The vehicle lamp 1A of the present embodiment includes the reflector 40 in the lamp chamber S. Light emitted from the LED light source 10 is reflected in a reflective surface of the reflector 40 and emitted to the front of the lamp.

The optical film 31 (an example of the optical member) is bonded to the reflective surface of the reflector 40. The optical film 31 can be formed by depositing a multi-layer film on the surface of, for example, an adhesive tape. The optical film 31 has the same optical characteristics as those shown in FIG. 2B. Therefore, the light, which is emitted from the LED light source 10 and reflected in the reflective surface of the reflector 40 having the optical film 31 provided thereon, has the same optical characteristics as those shown in FIG. 2C.

Also in the vehicle lamp 1A according to the present embodiment, light can be evidently irradiated to road signs having a color shade corresponding to the wavelength of the peak formed by the optical film 31. Therefore, visibility of the road signs can be improved. Further, also in the present embodiment, it is not necessary to separately provide a structure for supporting the optical member, and hence, it is not necessary to change the design of a vehicle lamp having an existing reflector. Thus, the present invention can be also applied to a vehicle lamp which does not use a projection lens. Further, the present invention can be also applied to a vehicle lamp which includes a projection lens and a reflector.

<Third Embodiment>

Figure 8:
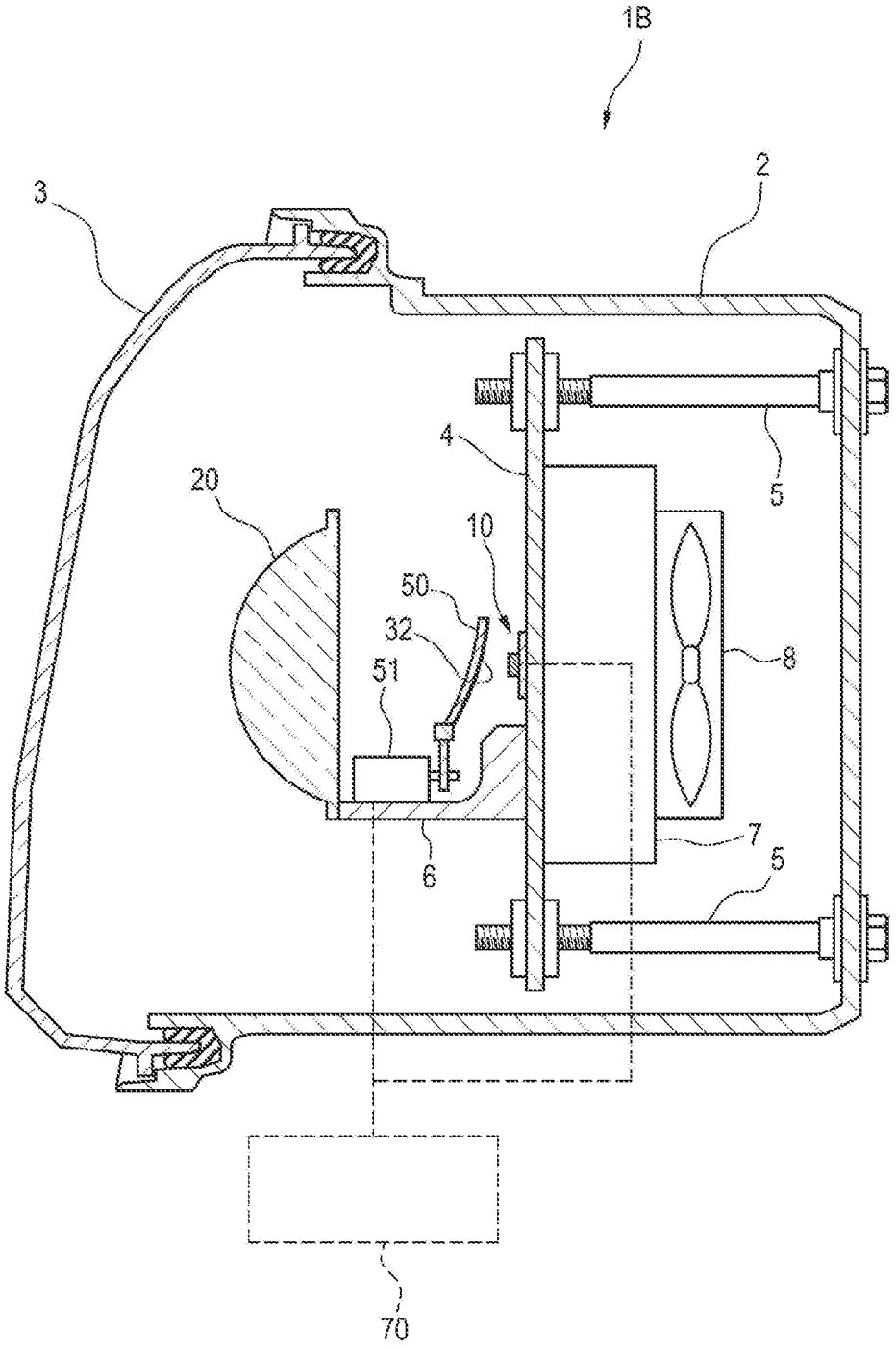
FIG. 8 is a side sectional view of a vehicle lamp according to a third embodiment of the present invention.

FIG. 8 is a side sectional view of a vehicle lamp according to a third embodiment of the present invention. The same members as those of the first embodiment described above are denoted by the same reference numerals and a detailed description thereof is omitted.

The vehicle lamp according to the present embodiment includes an inner lens 50 between the projection lens 20 and the LED light source 10. A multi-layer film filter 32 is formed on the surface of the inner lens 50 facing the LED light source 10.

The inner lens 50 is pivotable around a rotation axis directed in a longitudinal direction by a motor 51 attached to the lens holder 6. In this way, the multi-layer film filter 32 provided in the inner lens 50 is movable to a position on the optical path of light emitted from the LED light source 10 and a position deviated from the optical path.

Therefore, a normal state where light from the LED light source 10 is irradiated as it is and an object of various color shades is thus easily visible and a state where only the light with a specific wavelength band is illuminated by the multi-layer film filter 32 and visibility of road signs is thus improved can be switched by the driving of the motor 51. Thus, it is possible to provide a vehicle lamp 1B capable of improving visibility of road signs, as needed.

Further, in the present embodiment, the motor 51 and the LED light source 10 are preferably controlled by using a control means 70 such that the luminous intensity of light passed through the multi-layer film filter 32 is constant both when the multi-layer film filter 32 is located on the optical path and when the multi-layer film filter 32 is deviated from the optical path. In this way, the reflective brightness of a specific color shade portion of road signs can be periodically varied while the luminous intensity of light emitted from the vehicle lamp 1B is substantially constant. Therefore, visibility of the road signs can be further improved. The control means 70 may be mounted on the vehicle lamp 1B or may be incorporated into an ECU (Electronic Control Unit) of a vehicle.

<Fourth Embodiment>

Figure 9:
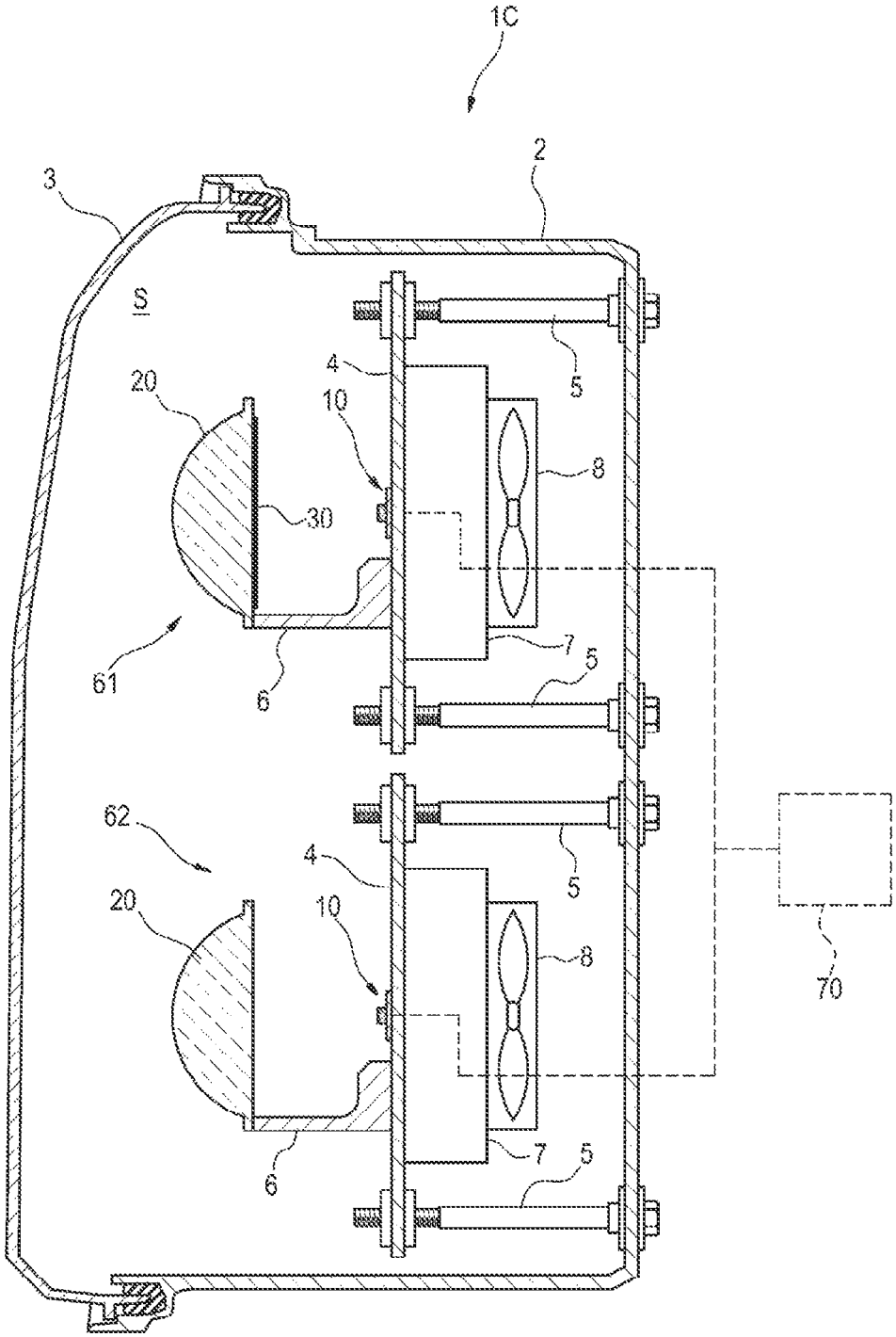
FIG. 9 is a side sectional view of a vehicle lamp according to a fourth embodiment of the present invention.

FIG. 9 is a side sectional view of a vehicle lamp 1C according to a fourth embodiment of the present invention. The same members as those of the first embodiment described above are denoted by the same reference numerals and a detailed description thereof is omitted.

The vehicle lamp 1C according to the present embodiment includes a first lamp unit 61 and a second lamp unit 62 in the lamp chamber S. Each of the first lamp unit 61 and the second lamp unit 62 includes the LED light source 10 and the projection lens 20 or the like and is configured to illuminate substantially the same range. While the multi-layer film filter 30 is provided on the projection lens 20 of the first lamp unit 61, the multi-layer film filter is not provided in the projection lens 20 of the second lamp unit 62. Therefore, the second lamp unit 62 emits a white light emitted from the light source as it is whereas the first lamp unit 61 emits a white light composed of only the light with a specific wavelength band out of light emitted from the light source.

By alternately lighting the first lamp unit 61 and the second lamp unit 62, the road signs are evidently visible and an object with various color shades can be made in a state of being easily visible. Preferably, the period of the lighting is set in a period such that the light does not appear as being flashed on and off for a driver.

Further, in the present embodiment, both of the LED light sources 10, 10 are preferably controlled by using the control means 70 such that luminous intensity of light emitted from the first lamp unit 61 is substantially the same as that of light emitted from the second lamp unit 62. In this way, the reflective brightness of a specific color shade portion of road signs can be periodically varied while the luminous intensity of light emitted from the vehicle lamp 1C is substantially constant. Therefore, visibility of the road signs can be further improved. The control means 70 may be mounted on the vehicle lamp 1C or may be incorporated into an ECU (Electronic Control Unit) of a vehicle.

Meanwhile, in each of the embodiments and the modified examples described above, an example where the multi-layer film filters 30, 32 or the optical film 31 formed by deposition is used as the optical member has been described. However, the present invention is not limited to this configuration.

For example, the optical member may be formed by applying material such as $Ta_2O_3$ described above on the surface of the projection lens 20, the reflector 40 or the inner lens 50. The optical member may be formed by incorporating specific material into the projection lens 20 so as to have the above-described optical characteristics. Alternatively, the optical member may be formed by forming fine irregularities on the surface of the projection lens 20 or the reflector 40 so as to have the above-described optical characteristics.

In each of the embodiments and each of the modified examples described above, an example where the LED light source 10 or the halogen light source 11 is used as the light source has been described. However, the present invention is not limited to these examples. As the light source, a known light source such as an incandescent bulb, a discharge bulb, an organic EL and a phosphor LD (Laser Diode) can be used.

Further, the above-described vehicle lamp is preferably mounted on a vehicle in such a way that an emission position of light from the lamp is positioned within 200 mm from a front end of a front window of a vehicle. As the emission position of the light approaches an eye point, visibility of road signs can be improved.

<Fifth Embodiment>

Next, a vehicle lamp according to a fifth embodiment of the present invention is described in detail with reference to the drawings. The vehicle lamp of the present embodiment is a lamp provided in a vehicle front portion.

For example, in Japanese Patent Laid-Open Publication No. 2011-100555 or the like, various suggestions for preventing the damage (so-called erosion) of resin components of the lamp by sunlight condensed by a projection lens have been made for a vehicle lamp.

An outer cover of a vehicle lamp is uniformly colorless and transparent and the vehicle lamps look like the same. Further, currently, there is no attempt to improve the design while preventing erosion.

Therefore, the fifth embodiment of the present invention provides a vehicle lamp having the design improved while preventing erosion.

Figure 10:
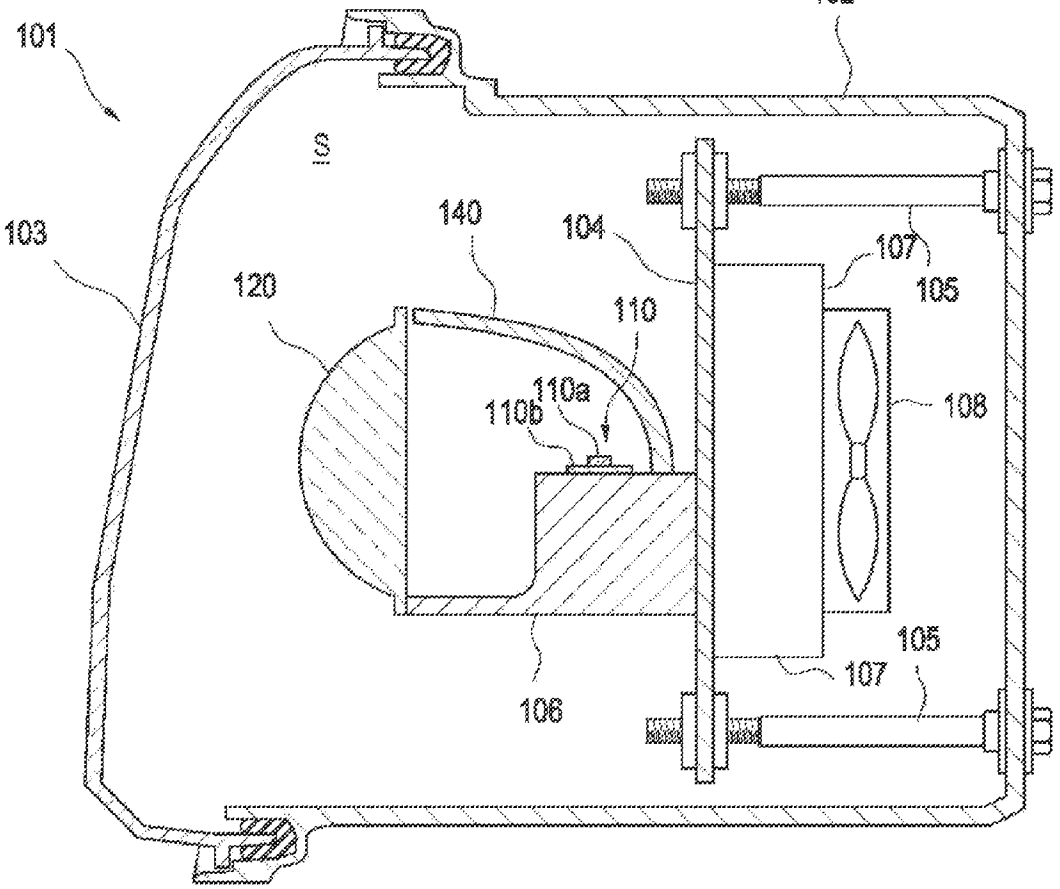
FIG. 10 is a side sectional view of a vehicle lamp according to a fifth embodiment of the present invention.

FIG. 10 is a side sectional view of a vehicle lamp 101 according to the present embodiment. As shown in FIG. 10, the vehicle lamp 101 includes a housing 102 having an opening on the front side and an outer cover 103 for closing the opening to form a lamp chamber S together with the housing 102. In the interior of the lamp chamber S, the vehicle lamp 101 includes an LED light source 110, and a reflector 140 and a projection lens 120, which are provided on an optical path of light emitted from the LED light source 110. The light emitted from the LED light source 110 is transmitted through the projection lens 120 by being reflected in the reflector 140 and is emitted to the front of the lamp through the outer cover 103.

The LED light source 110 includes an LED (Light Emitting Diode) element 110*a* and a circuit board 110*b* on which the LED element 110*a* is mounted. The LED element 110*a* has a light emitting element to emit a blue light and a phosphor to convert the blue light into a yellow light. The LED element emits a white light by mixing the blue light and the yellow light. The LED light source 110 is mounted on a holder 106 supported on a front surface of a support substrate 104. The support substrate 104 is attached to the housing 102 through an aiming screw 105.

The reflector 140 is mounted on the holder 106. The projection lens 120 is provided in front of the LED light source 110. The projection lens 120 is fixed to the holder 106.

A heat sink 107 and a heat dissipation fan 108 are provided on a rear surface of the support substrate 104. The heat sink 107 and the heat dissipation fan 108 dissipate heat generated from the LED light source 110 provided on the front surface of the support substrate 104.

In the present embodiment, the outer cover 103 as an example of the optical member has optical characteristics of attenuating the light with the wavelength between peaks in the spectrum of light emitted from the LED light source 110. The outer cover 103 exhibits an appearance of dark-smoke tone during non-lighting. For example, the outer cover 103 is formed by mixing specific-wavelength absorbing pigment or the like into transparent acrylic resin. In this way, the outer cover 103 having such optical characteristics can be realized.

Next, the optical characteristics of the vehicle lamp 101 are described with reference to FIGS. 11A to 11C and 12A to 12C.

Figure 11A:
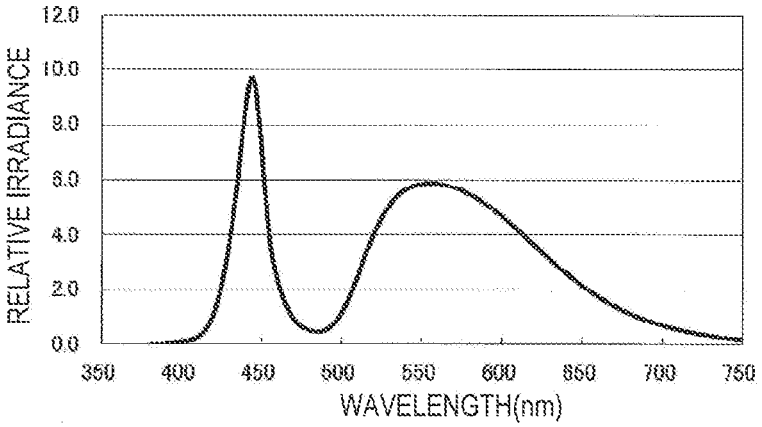
FIGS. 11A to 11C are views showing the optical characteristics of the vehicle lamp of the fifth embodiment.
Figure 11B:
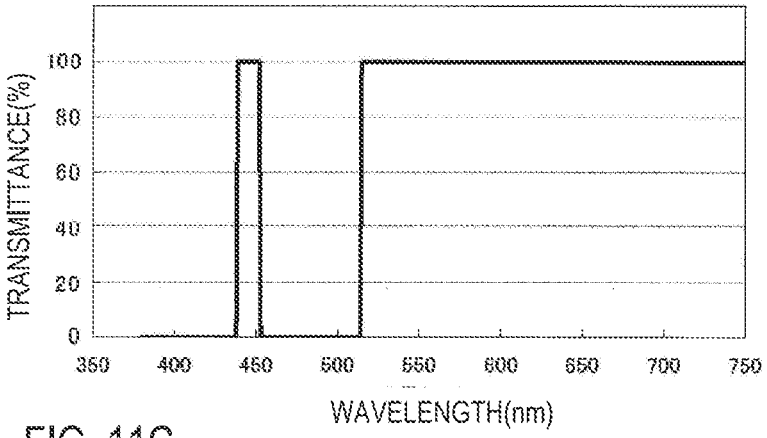
Figure 11C:
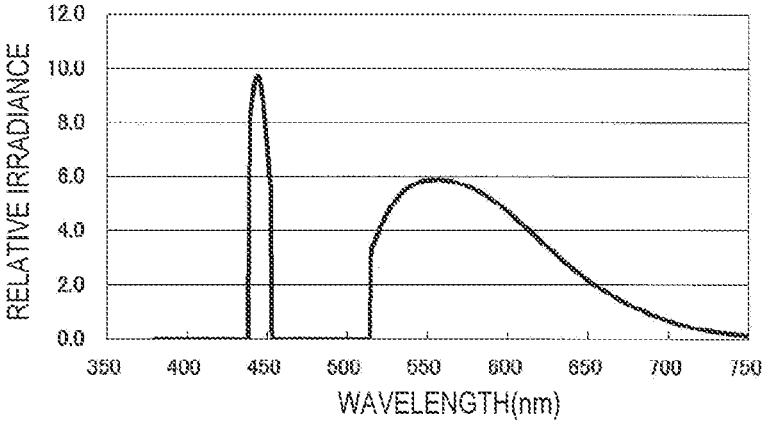

FIG. 11A is a view showing an emission spectrum of light emitted from the LED light source 110. FIG. 11B is a view showing a transmission spectrum of the outer cover 103. FIG. 11C is a view showing a spectrum of light transmitted through the outer cover 103.

As shown in FIG. 11A, the spectrum of light emitted from the LED light source 110 has two peaks in the visible light range. The spectrum of the light has peaks near 445 nm and near 560 nm.

As shown in FIG. 11B, the outer cover 103 of the present embodiment has optical characteristics that transmittance of light with the wavelength band of 440 nm to 450 nm and 520 nm to 750 nm is 100% and transmittance of light with the wavelength band of 450 nm to 520 nm is 0%. That is, the transmission spectrum of the outer cover 103 has a peak at a wavelength corresponding to a peak of the light emitted from the LED light source 110.

Therefore, as shown in FIG. 11C, the spectrum of light, which is emitted from the LED light source 110 and passes through the outer cover 130, has peaks near 445 nm and near 560 nm and is substantially the same as the spectrum of light emitted from the LED light source 110 shown in FIG. 11A.

Strictly, the light with the wavelength band of 440 nm or less and the light with the wavelength band of 450 nm to 520 nm are cut (100% attenuation) by the outer cover 103. However, as shown in FIG. 11A, out of the light emitted from the LED light source 110, the light with the wavelength of 440 nm or less and the light with the wavelength of 450 nm to 520 nm have low relative irradiance. The light with the wavelength of low relative irradiance is attenuated in the outer cover 103.

On the other hand, as shown in FIG. 11A, out of the light emitted from the LED light source 110, the light with the wavelength of 440 nm to 450 nm and the light with the wavelength of 520 nm to 750 nm have high relative irradiance. The light with the wavelength of high relative irradiance is not shielded in the outer cover 103.

Therefore, considering the entire wavelength band, the light emitted from the LED light source 110 is not greatly attenuated by the outer cover 103.

Figure 12A:
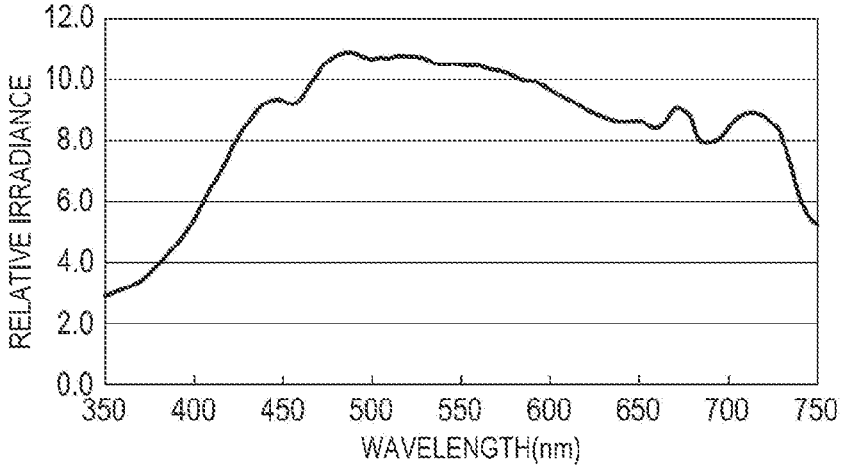
FIGS. 12A to 12C are views showing the optical characteristics of the vehicle lamp of the fifth embodiment.
Figure 12B:
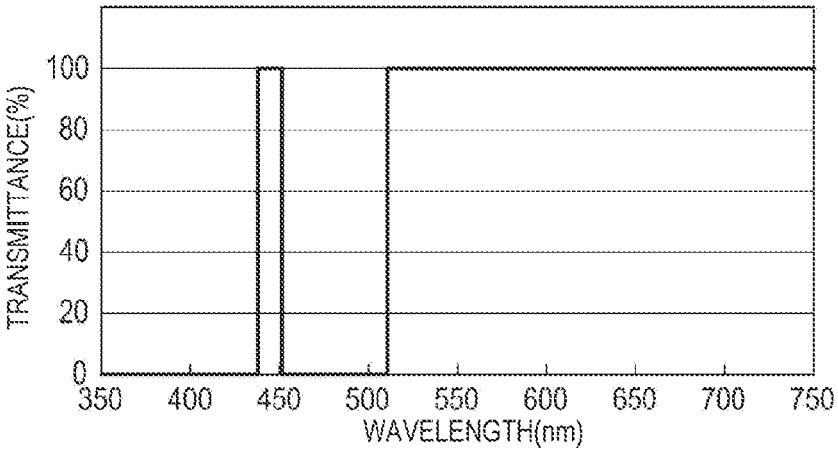
Figure 12C:
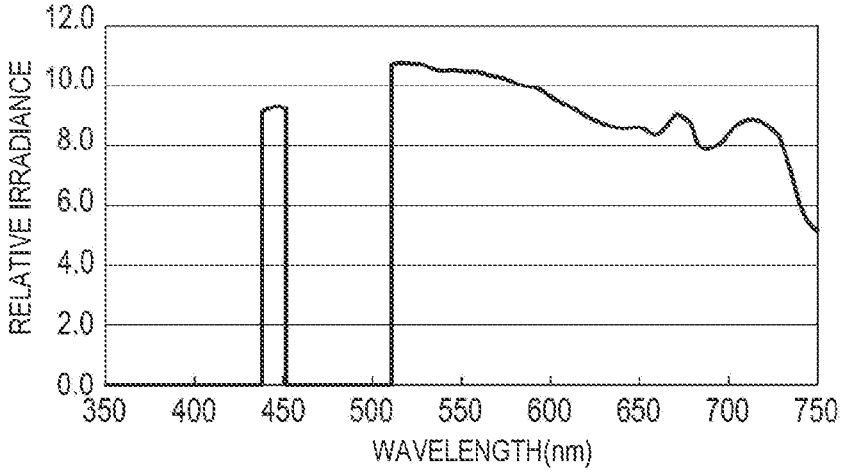

Subsequently, a case where sunlight enters the lamp chamber S via the outer cover 103 is described with reference to FIGS. 12A to 12C. FIG. 12A is a view showing the spectrum of sunlight before being incident on the outer cover 103. FIG. 12B is a view similar to FIG. 11B, showing a transmission spectrum of the outer cover 103. FIG. 12C is a view showing a spectrum of sunlight transmitted through the outer cover 103.

As shown in FIG. 12A, sunlight has high relative irradiance over the entire wavelength band of visible light. Therefore, when sunlight passes through the outer cover 103 having the transmission spectrum shown in FIG. 12B, the light with the wavelength of 440 nm or less and the light with the wavelength of 450 to 520 nm are attenuated, as shown in FIG. 12C.

As shown in FIG. 12A, out of the light included in sunlight, the light with the wavelength band of 440 nm or less and the light with the wavelength band of 450 to 520 nm have relative irradiance which is great the same extent as the light with other wavelength bands. In this way, the light having high relative irradiance is cut by the outer cover 103. Therefore, considering the entire wavelength band, sunlight is greatly attenuated by the outer cover 103.

Therefore, when viewing the vehicle lamp 101 from the outside during non-lighting, the sunlight attenuated enters the lamp chamber S, and hence, the outer cover 103 is seen in the dark-smoke tone. As compared with a vehicle lamp which has a conventional colorless and transparent outer cover, the outer cover 103 gives a unique impression, and thus, the vehicle lamp 101 with high appearance design is provided. Especially, since the outer cover 103 occupies a large area of the vehicle lamp 101 as seen from the front, the design of the vehicle lamp 101 is greatly enhanced.

Further, since the sunlight entering the lamp chamber S is attenuated, the energy of light entering the lamp chamber S is low. Therefore, erosion does not occur, even when sunlight is condensed on the surface of the support substrate 104 or the holder 106 by the projection lens 120 or the reflector 140 or the like. Further, in addition to the support substrate 104 or the holder 106, erosion of resin members provided in the lamp chamber S, such as an extension or a shade, can be prevented.

Further, as described in FIGS. 11A to 11C, the outer cover 103 attenuates the light with the wavelength between peaks of light emitted from the LED light source 110. Further, the outer cover 103 does not greatly reduce the energy of the light. Therefore, it is possible to provide the vehicle lamp 101 which has new design and is capable of preventing erosion while maintaining high light utilization efficiency.

Further, according to the vehicle lamp 101 of the present embodiment, the transmission spectrum of the outer cover 103 has a peak at a wavelength corresponding to a peak of light emitted from the LED light source 110, as shown in FIGS. 11A to 11C. Since the outer cover 103 does not hinder the light with the wavelength of high illumination, which is emitted from the LED light source 110, it is possible to provide the vehicle lamp 101 which has new design and is capable of preventing erosion while maintaining high light utilization efficiency.

(Fourth Modified Example)

Meanwhile, the outer cover is not limited to those having the transmission spectrum shown in FIG. 11B. For example, when a RGB laser is adopted as the light source, the outer cover 103 which has a transmission spectrum for attenuating the light with the wavelength between peaks of light emitted from the RGB laser may be adopted.

Figure 13A:
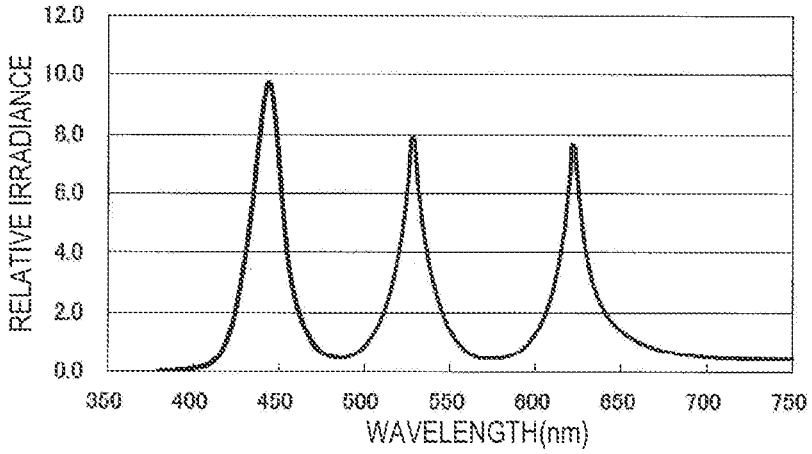
FIGS. 13A to 13C are views showing the optical characteristics of a vehicle lamp according to a fourth modified example of the present invention.
Figure 13B:
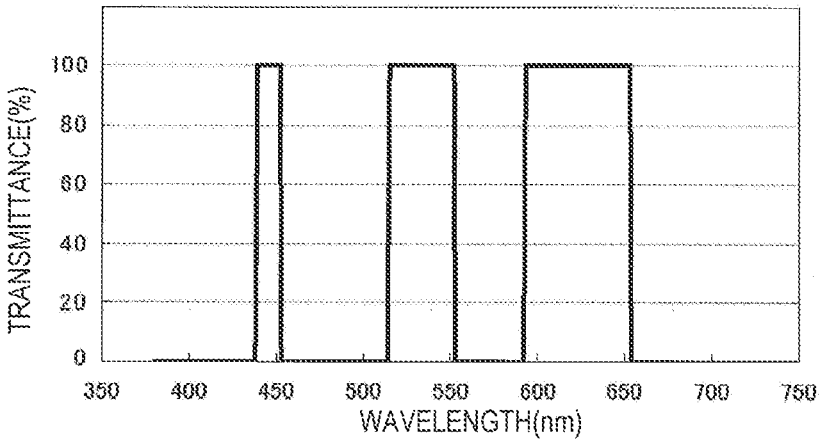
Figure 13C:
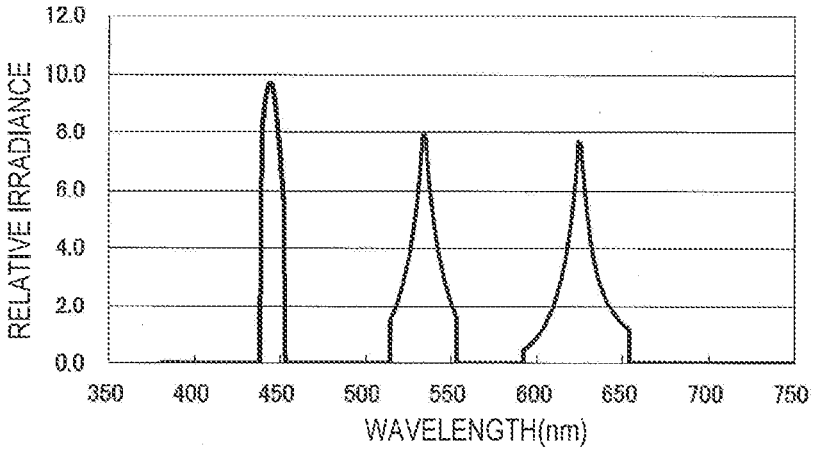

FIGS. 13A to 13C are views for explaining the optical characteristics of a vehicle lamp according to a fourth modified example of the present invention, which adopts the RGB laser as the light source. FIG. 13A is a view showing a spectrum of light emitted from the RGB laser light source. FIG. 13B is a view showing a transmission spectrum of the outer cover 103. FIG. 13C is a view showing a spectrum of light passed through the outer cover 103.

The RGB laser light source of the present modified example emits light having a peak near the wavelength of 445 nm, a peak near the wavelength of 525 nm and a peak near the wavelength of 620 nm, as shown in FIG. 13A.

As shown in FIG. 13B, the outer cover 103 of the present modified example has characteristics that transmittance of light with the wavelength of 440 nm to 450 nm, 520 nm to 550 nm and 590 nm to 650 nm is 100% and transmittance of light with other wavelength bands is 0%. That is, the outer cover 103 attenuates light with the wavelength between peaks of light emitted from the RGB laser light source.

Therefore, as shown in FIG. 13C, the spectrum of light, which is emitted from the RGB laser light source and passes through the outer cover 103, has peaks near 445 nm, 525 nm and 620 nm. This spectrum is substantially the same as the spectrum of light emitted from the RGB laser light source shown in FIG. 13A.

Strictly, the light with the wavelength band of 440 nm or less, 450 nm to 520 nm, 550 nm to 590 nm, and 650 nm or more is attenuated by the outer cover 103. However, the light with the above wavelength band, which is emitted from the RGB laser light source, has low relative irradiance. Therefore, the light passed through the outer cover 103 is not greatly attenuated.

On the contrary, when sunlight enters the lamp chamber S via the outer cover 103, the sunlight is greatly attenuated by the outer cover 103. Out of sunlight having a continuous spectrum, the light with the wavelength band of 440 nm or less, 450 nm to 520 nm, 550 nm to 590 nm, and 650 nm or more is attenuated by the outer cover 103, and thus, the energy of sunlight is greatly lowered by the outer cover 103.

Therefore, when viewing the vehicle lamp 101 from the outside during non-lighting, the outer cover 103 is seen in the dark-smoke tone. As compared with a vehicle lamp which has a conventional colorless and transparent outer cover, the appearance design of the vehicle lamp 101 of the present modified example is enhanced. Further, the energy of sunlight entering the lamp chamber S is lowered, and hence, erosion is less likely to occur.

Thus, also in the present modified example, the vehicle lamp 101 where erosion is prevented and design is enhanced is provided.

Meanwhile, in the embodiments and the modified examples described above, an example where the outer cover 103 has a transmission spectrum shown in FIG. 11B or FIG. 13B and is seen in the dark-smoke tone during non-lighting has been described. However, the present invention is not limited to this configuration. As described above, in the case where the outer cover 103 has a transmission spectrum for attenuating the light with the wavelength between peaks of light emitted from the light source, the outer cover 103 may have a specific color shade such as, for example, blue or red during non-lighting. In this way, it is possible to provide the vehicle lamp 101 that has a unique appearance and an excellent appearance design.

Further, in the first embodiment described above, an example where the outer cover 103 is caused to have a specific transmission spectrum has been described. However, the present invention is not limited to this configuration. The optical member having the transmission spectrum as shown in FIG. 11B or FIG. 13B may be the projection lens 120 or an inner lens disposed in the lamp chamber S, such as a light guide, so long as the optical member is a member provided on an optical path of light emitted from the light source. Alternatively, the optical member may be the reflector 140 for reflecting the light emitted from the light source.

In this case, in the front view of the vehicle lamp 101, an inner lens or the reflector 140 constituting a portion of the lamp exhibits a smoke tone or a specific color shade. Therefore, it is possible to provide a vehicle lamp having good appearance design in which the inner lens or the reflector 140 is noticeable.

In the fifth embodiment and the fourth modified example described above, an example where the LED light source having two peaks and the RGB laser light source having three peaks are adopted as the light source has been described. However, the present invention is not limited to these configurations. For example, an LED light source, an LD (Laser Diode) light source, a discharge bulb or an organic EL or the like, which emits light having a plurality of peaks, can be adopted as the light source.

Figure 14:
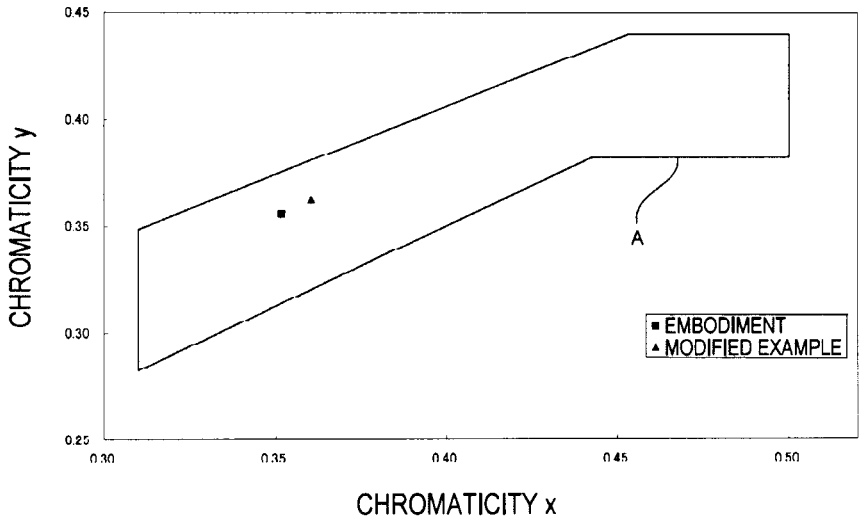
FIG. 14 is a view showing chromaticity of light that is irradiated by the vehicle lamp.

Further, the light source and the optical member are preferably designed such that the light illuminated from the vehicle lamp 101 is a white light. FIG. 14 shows the measurement results of chromaticity of light emitted from the vehicle lamp 101 according to the fifth embodiment and the fourth modified example. As shown in FIG. 14, chromaticity of light emitted from the vehicle lamp 101 according to the fifth embodiment and the fourth modified example is included in a chromaticity range A suitable for a vehicle headlamp, in which chromaticity x and y is specified in JIS D5500, and the vehicle lamp 1 emits a white light to the front of the lamp. Therefore, the vehicle lamp 101 according to the fifth embodiment and the fourth modified example can be applied to an existing vehicle headlamp.

Meanwhile, a means for giving desired optical characteristics to the optical member such as the outer cover 103 is not limited to those described above. For example, it is possible to give desired optical characteristics to the optical member by laminating $Ta_2O_3$, $Ti_2O_3$ or $Si_2O_3$ or the like on the surface of the optical member. Alternatively, a film having $Ta_2O_3$, $Ti_2O_3$ or $Si_2O_3$ or the like laminated thereon may be bonded to the optical member. Alternatively, a desired optical member may be provided by forming fine irregularities on the surface of the optical member so as to have the above-described optical characteristics.

Further, in FIG. 11B and FIG. 13B, an optical member having a transmission spectrum whose transmittance is 0% or 100% has been exemplified. However, the present invention is not limited to this configuration. An optical member having a transmission spectrum whose transmittance takes any value between 0 to 100% may be adopted. Further, an optical member having a transmission spectrum whose transmittance is continuously varied with respect to the wavelength may be adopted.

In addition, the vehicle lamp 101 shown in FIG. 10 is just an example of a vehicle lamp to which the present invention is applicable. For example, the present invention can be applied to a vehicle lamp which does not include a reflector and in which light from a light source is condensed in the projection lens and emitted to the front of the lamp. Alternatively, the present invention can be also applied to a vehicle lamp which does not include a projection lens and in which light from the light source is controlled by a reflector and emitted to the front of the lamp. The present invention can be applied to various vehicle lamps such as a headlamp, a rear combination lamp or a fog lamp.

Further, the present invention is not limited to the configurations described in the above embodiments and modified examples thereof but may employ a configuration that other various modifications are applied thereto.

This application is based upon Japanese Patent Application (Patent Application No. 2014-011344) filed on Jan. 24, 2014 and Japanese Patent Application (Patent Application No. 2014-017398) filed on Jan. 31, 2014, and the contents of which are incorporated herein by reference.

INDUSTRIAL APPLICABILITY

According to the present invention, a vehicle lamp with high visibility of road signs is provided.

REFERENCE NUMERALS LIST

1: Vehicle Lamp, 2: Housing, 3: Outer Cover, 4: Support Substrate, 5: Aiming Screw, 6: Lens Holder, 7: Heat Sink, 8: Heat Dissipation Fan, 10: LED Light Source, 11: Halogen Light Source, 10*a*: LED Element, 10*b*: Circuit Board, 20: Projection Lens, 30: Multi-layer Film Filter, 31: Optical Film, 40: Reflector, 50: Inner Lens, 61: First Lamp Unit, 62: Second Lamp Unit, 70: Control Means, 101: Vehicle Lamp, 102: Housing, 103: Outer Cover, 104: Support Substrate, 105: Aiming Screw, 106: Holder, 107: Heat Sink, 108: Heat Dissipation Fan, 110: LED Light Source, 111: Halogen Light Source, 110*a*: LED Element, 110*b*: Circuit Board, 120: Projection Lens, 140: Reflector, A: chromaticity range, S: Lamp Chamber

What is claimed is:

1. A vehicle lamp comprising:

a light source configured to emit light of a spectrum having at least two peaks; and an optical member provided on an optical path of the light and configured to attenuate light having a wavelength between the peaks of the light.

2. The vehicle lamp according to claim 1, comprising:

a housing having an opening on the front side, wherein the optical member is an outer cover which closes the opening to form a lamp chamber together with the housing.

3. The vehicle lamp according to claim 1, comprising:

a housing having an opening; and an outer cover for closing the opening to form a lamp chamber together with the housing, wherein the optical member is an inner lens provided on the optical path in the lamp chamber.

4. The vehicle lamp according to claim 1, wherein the optical member is a reflector which is provided on the optical path and reflects light emitted from the light source.

5. The vehicle lamp according to claim 1, wherein a transmission spectrum of the optical member has a peak at a wavelength corresponding to the peak of light emitted from the light source.

6. The vehicle lamp according to claim 1, wherein the light source emits light having at least two peaks which become a white light when combined with each other.

* * * * *